US007735883B2

(12) United States Patent
Inoue et al.

(10) Patent No.: US 7,735,883 B2
(45) Date of Patent: Jun. 15, 2010

(54) LATCH DEVICE

(75) Inventors: Jiro Inoue, Yamanashi (JP); Aya Morokata, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/826,417

(22) Filed: Jul. 16, 2007

(65) Prior Publication Data

US 2008/0088137 A1 Apr. 17, 2008

(30) Foreign Application Priority Data

Oct. 17, 2006 (JP) ..... 2006-282403

(51) Int. Cl.
*E05C 9/00* (2006.01)

(52) U.S. Cl. ..... 292/216; 292/201; 292/DIG. 23; 292/336.3

(58) Field of Classification Search ..... 292/201, 292/216, DIG. 23, 336.3
See application file for complete search history.

(56) References Cited

U.S. PATENT DOCUMENTS

| | | | | |
|---|---|---|---|---|
| 4,858,971 | A * | 8/1989 | Haag et al. | 292/201 |
| 5,785,364 | A * | 7/1998 | Kleefeldt et al. | 292/201 |
| 6,048,003 | A * | 4/2000 | Shimura | 292/216 |
| 6,386,599 | B1 * | 5/2002 | Chevalier | 292/201 |
| 6,428,058 | B1 * | 8/2002 | Graute | 292/216 |
| 6,439,623 | B1 | 8/2002 | Lohfeld et al. | |
| 6,471,259 | B1 * | 10/2002 | Weyerstall et al. | 292/201 |
| 6,848,286 | B2 * | 2/2005 | Dimig | 70/277 |
| 6,964,438 | B2 | 11/2005 | Koike et al. | |
| 7,243,973 | B2 * | 7/2007 | Plett et al. | 296/57.1 |
| 7,309,100 | B2 * | 12/2007 | Sawajiri | 296/146.1 |
| 2002/0117862 | A1 * | 8/2002 | Yamauchi et al. | 292/201 |
| 2003/0067175 | A1 * | 4/2003 | Shiota et al. | 292/201 |
| 2005/0121920 | A1 * | 6/2005 | Machida | 292/201 |
| 2005/0167991 | A1 * | 8/2005 | Yoneyama | 292/201 |
| 2005/0218662 | A1 * | 10/2005 | Umino | 292/216 |

(Continued)

FOREIGN PATENT DOCUMENTS

DE 199 04 663 A1 8/2000

(Continued)

OTHER PUBLICATIONS

U.S. Appl. No. 11/826,606, filed Jul. 17, 2007, Jiro Inoue et al.

(Continued)

*Primary Examiner*—Peter M Cuomo
*Assistant Examiner*—Kristina R Fulton
(74) *Attorney, Agent, or Firm*—Foley & Lardner LLP

(57) ABSTRACT

A latch mechanism holds a door body in a half-closed state or a fully-closed state with respect to a vehicle body. An open lever connected to an operating handle on the door body releases the half-closed state or the fully-closed state. A release assisting unit triggered by the opening operation of the operating handle assists the release of the half-closed state or the fully-closed state of the door body. A charging device charges a portion of a driving current supplied to a driving source of a lock mechanism between the operating handle and the latch mechanism, and supplies a charged driving current to the release assisting unit.

2 Claims, 8 Drawing Sheets

U.S. PATENT DOCUMENTS

| | | | | |
|---|---|---|---|---|
| 2006/0125244 | A1* | 6/2006 | Mochizuki et al. | 292/201 |
| 2006/0163883 | A1* | 7/2006 | Hoshikawa et al. | 292/216 |
| 2006/0267350 | A1* | 11/2006 | Ichinose et al. | 292/201 |

FOREIGN PATENT DOCUMENTS

| | | | |
|---|---|---|---|
| DE | 102004052599 | A1 | 5/2006 |
| EP | 1 048 808 | B1 | 11/2000 |
| JP | 4-68182 | U | 6/1992 |
| JP | 7-21956 | U | 4/1995 |
| JP | 10-046893 | A | 2/1998 |
| JP | 2003-278426 | A | 10/2003 |
| JP | 2005-166575 | A | 6/2005 |

OTHER PUBLICATIONS

Jiro Inoue et al., USPTO Office Action, U.S. Appl. No. 11/826,606, Sep. 15, 2009, 11 pgs.
Jiro Inoue et al., USPTO Office Action, U.S. Appl. No. 11/826,606, Apr. 14, 2010, 8 pages.

* cited by examiner

LATCH DEVICE

This application claims priority from Japanese Patent Application No. 2006-282403, filed Oct. 17, 2006, which is incorporated herein by reference in its entirety.

BACKGROUND OF THE INVENTION

1. Field of the Invention

The present invention relates to a latch device, and more particularly, to a latch device for releasing a half-closed state and a fully-closed state of a door body held by a latch mechanism.

2. Description of the Related Art

As a latch device provided on a vehicle such as a four-wheel automobile, a latch device having a latch mechanism and an open lever has been known. The latch mechanism includes a latch and a ratchet.

The latch is pivotally supported on a door body of, for example, a side door via a latch shaft, and is arranged so as to be oscillatable around the axis of the latch shaft in modes of opening operation and closing operation. The latch is always biased in the direction of opening operation by a latch spring, which is a biasing unit, and performs a closing operation against the biasing force created by the latch spring as a result of the closing operation of the door body, thereby becoming a state of being engaged with, for example, a striker disposed on a vehicle body.

Similar to the latch, the ratchet is pivotally supported on a door body via a ratchet shaft, and is arranged so as to be oscillatable around the axis of the ratchet shaft in modes of engaging operation and disengaging operation. The ratchet is always biased in the direction of engaging operation by a ratchet spring, which is a biasing unit, and is engaged with the latch by the engaging operation performed by the biasing force of the ratchet spring to maintain the state in which the latch is engaged with the striker, and on the other hand, releases the engaging state by performing the disengaging operation against the biasing force of the ratchet spring.

The open lever connects with an operating handle provided on the door body, namely, an outside handle provided on the outside of the side door and an inside handle provided on the inside of the side door, and is arranged so as to be oscillatable in a mode of door opening operation by the opening operation of the operating handle. The open lever disengages the ratchet against the biasing force of the ratchet spring by the door opening operation.

In such a latch device, the latch and the striker are made in an engaging state by the closing operation of the door body, and the ratchet is engaged to maintain the engaging state, by which the door body is made in a half-closed state or a fully-closed state with respect to the vehicle body, and on the other hand, the operating handle is operated to open the door and the open lever is operated to open the door to release the engaging state, by which the door body is allowed to open.

In the latch device, the engaged ratchet is engaged with the ratchet in the state of being engaged with the striker and the engaged state is maintained, by which the door body is made in a half-closed state or a fully-closed state with respect to the vehicle body. However, depending on the type of latch device, especially when the door body is in a fully-closed state with respect to the vehicle body, in a portion in which the ratchet engages with the latch, the reaction force (biasing force) of the latch spring and the reaction force of a seal member, such as a weather strip, provided between the vehicle body and the door body acts, and resultantly a high frictional force may be generated.

Therefore, when the operating handle (the outside handle and the inside handle) is operated to open the door, and the open lever is operated to open the door to disengage the ratchet, the frictional force acts as a resistance force, by which the operation load of operating handle is increased than needed. Such an increase in operation load of the operating handle may cause a difficulty in opening operation of the operating handle for a user such as an old person, a child, a handicapped person, and a sick person.

To solve the problem, a latch device has been proposed that has a power release mechanism that disengages the ratchet by the power of a motor resulting from the opening operation of operating handle performed by the user to aid the opening operation of the operating handle (see, for example, Japanese Utility Model Application Laying-open No. H7-21956, Japanese Patent Application Laying-open No. 2003-278426, and Japanese Utility Model Application Laying-open No. H4-68182).

However, in the latch device proposed in the. Patent Documents, a power mechanism having motor power, such as the power release mechanism, requires a high cost and an excessive installation space, which presents a problem in that the manufacturing cost is required, and the size of device increases.

On the other hand, between the operating handle and the latch mechanism, there is provided a lock mechanism that is switched over between an unlocked state in which the opening operation of operating handle is effective and a locked state in which the opening operation of operating handle is ineffective. By supplying a driving current from a power source such as a battery mounted on the vehicle to an actuator that serves as a driving source for the lock mechanism, the lock mechanism is driven. However, only some of the supplied driving current is utilized for driving the lock mechanism, and the remaining current is not utilized whatsoever.

SUMMARY OF THE INVENTION

It is an object of the present invention to at least partially solve the problems in the conventional technology.

A latch device according to one aspect of the present invention includes a latch mechanism that is disposed on one of a vehicle body and a door body, and holds the door body in a half-closed state or a fully-closed state with respect to the vehicle body; an open lever that is connected to an operating handle provided on the door body and disposed oscillatably to perform a door opening operation by an opening operation of the operating handle, and releases the half-closed state or the fully-closed state held by the latch mechanism by the door opening operation; a release assisting unit that is triggered by the opening operation of the operating handle, and assists the release of the half-closed state or the fully-closed state of the door body by the open lever; and a charging device that charges a portion of a driving current supplied to a driving source of a lock mechanism that is switched over between an unlocked state in which the opening operation of operating handle is enabled and a locked state in which the opening operation of operating handle is disabled between the operating handle and the latch mechanism, and supplies a charged driving current to the release assisting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
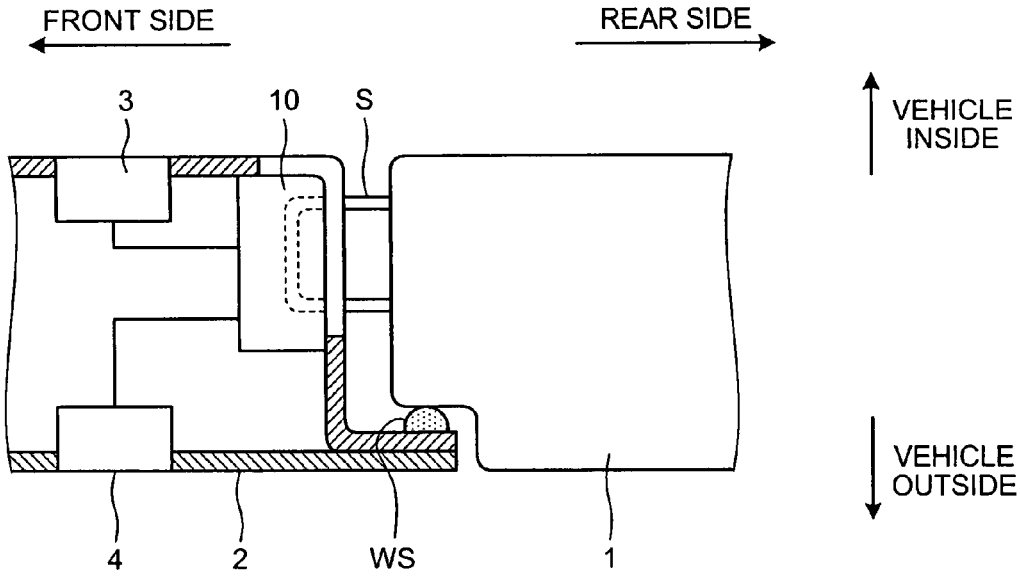
FIG. 1 is an explanatory view showing an essential portion of a vehicle to which a latch device according to an embodiment of the present invention is applied.
Figure 2:
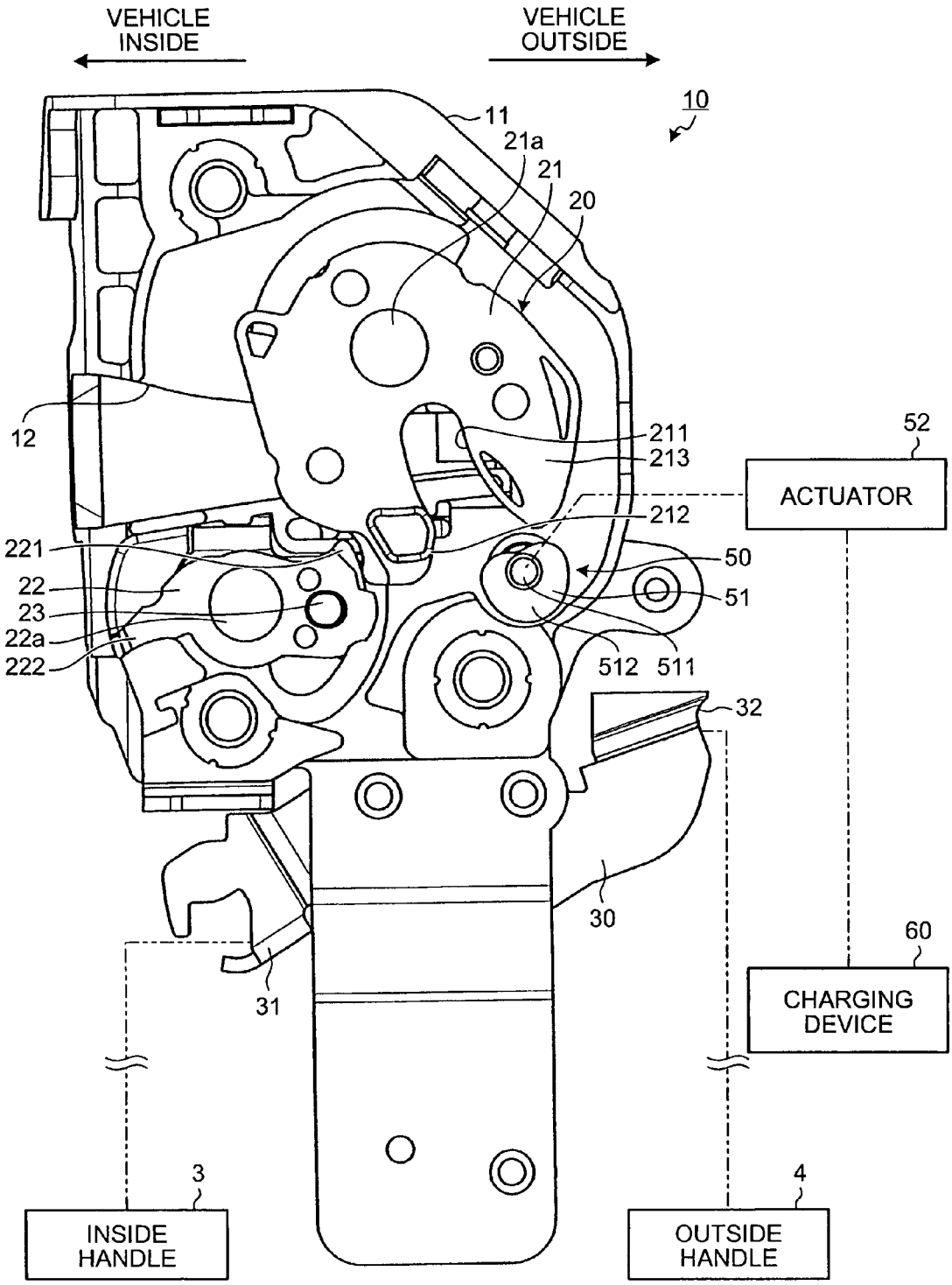
FIG. 2 is a back view showing a configuration of a latch device according to the embodiment, viewed from the rear side of a vehicle.

FIG. 1 is an explanatory view showing an essential portion of a vehicle to which a latch device 10 according to an embodiment of the present invention is applied. FIG. 2 is a back view showing a configuration of the latch device 10, viewed from the rear side of a vehicle. The latch device 10 typically shown in these figures is provided in a rear edge portion of a hinge-type side door (door body) 2 disposed so as to be openable/closable with respect to a vehicle body 1 on a vehicle such as a four-wheel automobile, and is configured so as to have a latch mechanism 20 and an open lever 30.

The latch mechanism 20 makes the side door 2 in a half-closed state or in a fully-closed state when being engaged with a striker S provided on the vehicle body 1, and is configured so as to have a latch 21 and a ratchet 22 in a latch housing 11.

The latch housing 11 has a notch groove 12 through which the striker S can pass, and is installed on the side door 2 in a state in which the notch groove 12 is arranged in a region in which the striker S is relatively moved by the opening and closing of the side door 2.

Figure 3:
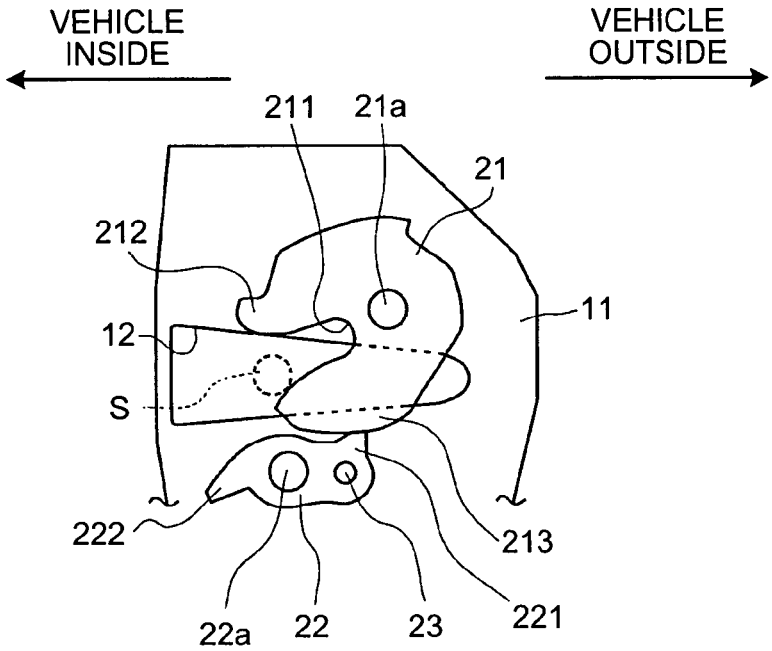
FIG. 3 is a schematic view showing an open state of a latch mechanism shown in FIG. 2.
Figure 4:
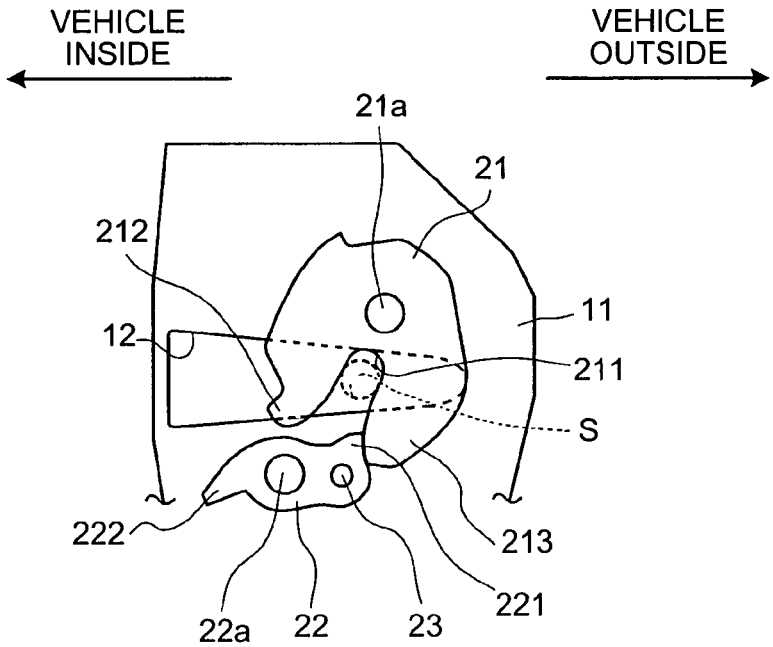
FIG. 4 is a schematic view showing a half latch state of a latch mechanism shown in FIG. 2.

As shown in FIGS. 3 and 4, the latch 21 is disposed at a position above the notch groove 12 provided in the latch housing 11 so as to be turnable around the axis of a latch shaft 21*a* via the latch shaft 21*a* extending substantially horizontally along the front and rear direction of the vehicle. More specifically, in FIGS. 2 to 5, the latch 21 is disposed so as to be turnable in the clockwise direction to open the door, and on the other hand, in the counterclockwise direction to close the door. The latch 21 has an engagement groove 211, a hook unit 212, and a locking unit 213.

The engagement groove 211 is formed from the outer peripheral face of the latch 21 toward the latch shaft 21*a* so as to have a width capable of accommodating the striker S.

Figure 5:
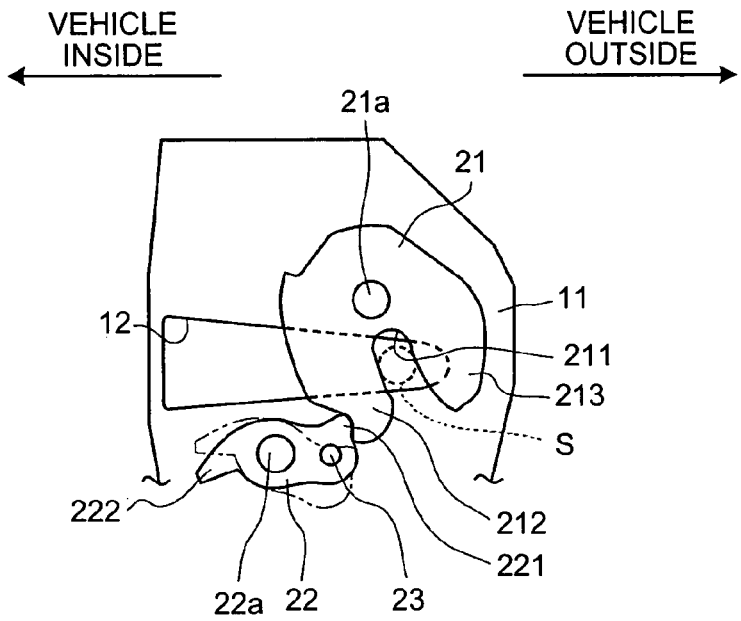
FIG. 5 is a schematic view showing a full latch state of a latch mechanism shown in FIG. 2.

The hook unit 212 is a unit that is located on the vehicle inside of the engagement groove 211 when the engagement groove 211 is open downward as shown in FIG. 4. The hook unit 212 is configured so that as shown in FIG. 5, when the latch 21 is turned counterclockwise (operated to close the door), the hook unit 212 stops at a position at which it crosses the notch groove 12 in the latch housing 11, and on the other hand, as shown in FIG. 3, when the latch 21 is turned clockwise (operated to open the door), the hook unit 212 stops at a position at which it opens the notch groove 12 (open position).

The locking unit 213 is a unit that is located on the vehicle outside of the engagement groove 211 when the engagement groove 211 is open downward as shown in FIG. 4. The locking unit 213 is configured so that as shown in FIG. 3, when the latch 21 is turned clockwise, the locking unit 213 stops in a state in which it crosses the notch groove 12, and tilts upward gradually toward the inner part of the notch groove 12 (the vehicle outside). Between the latch 21 and the latch housing 11, a latch spring (biasing unit) is provided to always bias the latch 21 toward the clockwise direction (direction of opening operation) in FIGS. 3 to 5.

The ratchet 22 is disposed at a position under the notch groove 12 in the latch housing 11 and on the vehicle inside of the latch shaft 21*a* so as to be oscillatable around the axis of a ratchet shaft 22*a* via the ratchet shaft 22*a* extending substantially horizontally along the front and rear direction of the vehicle. More specifically, in FIGS. 2 to 5, the ratchet 22 is disposed so as to be oscillatable in the counterclockwise direction to engage with the latch 21, and on the other hand, in the clockwise direction to disengage from the latch 21. The ratchet 22 has an engagement unit 221 and a working unit 222.

The engagement unit 221 is a unit extending in the radial direction from the ratchet shaft 22*a* toward the vehicle outside. When the ratchet 22 turns counterclockwise in FIGS. 3 to 5 (when operated to engage with the latch), the engagement unit 221 can engage with the hook unit 212 or the locking unit 213 of the latch 21 via the projecting end face thereof. The working unit 222 is a unit extending in the radial direction from the ratchet shaft 22*a* toward the vehicle inside.

The ratchet 22 is provided with a ratchet lever, not shown, via a connecting pin 23. Like the ratchet 22, the ratchet lever is disposed so as to be oscillatable around the axis of the ratchet shaft 22*a* via the ratchet shaft 22*a*, and oscillates integrally with the ratchet 22. Between the ratchet lever and the latch housing 11, a ratchet lever spring is provided to always bias the ratchet lever toward the counterclockwise direction in FIGS. 2 to 5. Thereby, the ratchet 22 is always biased toward the counterclockwise direction (the direction of engaging operation).

The open lever 30 is disposed below the ratchet 22 (ratchet lever) in the latch housing 11 so as to be oscillatable around the axis of an open lever shaft (not shown) via the open lever shaft. Also, between the open lever 30 and the latch housing 11, an open lever spring (not shown) is provided to always bias the open lever 30 toward the counterclockwise direction in FIG. 2. In the normal state, as shown in FIG. 2, by the biasing force of the open lever spring, the open lever 30 is disposed so that a first connecting unit 31 is located on the vehicle inside and a second connecting unit 32 is located on the vehicle outside. The first connecting unit 31 is connected to an inside handle 3, which is an operating handle provided on the inside of the side door 2, via a connecting mechanism such as a cable, not shown. The second connecting unit 32 is connected to an outside handle 4, which is an operating handle provided on the outside of the side door 2, via a connecting mechanism such as a cable, not shown.

When the inside handle 3 or the outside handle 4 is operated to open the door, the open lever 30 oscillates clockwise in FIG. 2, that is, operates to open the door against the biasing force of the open lever spring.

When the open lever 30 operates to open the door (oscillates clockwise) as described above, one end face of the open lever 30 comes into contact with the ratchet lever, and presses the ratchet lever, by which the ratchet lever is oscillated clockwise in FIGS. 2 to 5 against the ratchet lever spring. Thereby, the ratchet 22 performs a disengaging operation (oscillates clockwise in FIGS. 2 to 5) integrally with the ratchet lever. Thus, between the opening operation of the operating handle (the inside handle 3, the outside handle 4) and the disengaging operation of the ratchet 22, a time lag due to the driving of connecting mechanism and the oscillation of the open lever 30 is present. For the reason, mechanical plays of the connecting mechanism, the open lever 30, and the like are provided between the operating handle and the ratchet 22. That is to say, the operating handle is operated to open the door, and after the mechanical play has been absorbed, the ratchet 22 performs the disengaging operation.

On the other hand, between the latch mechanism 20 and the open lever 30, a lock mechanism is provided. The lock mechanism, which has been known conventionally, is switched over between an unlocked state in which the opening operation of the operating handle is effective and a locked state in which the opening operation of the operating handle is ineffective.

The latch device 10 has a release assisting unit 50 and a charging device 60. The release assisting unit 50 has a lever member 51, an actuator 52, and a detection switch 53. As shown in FIG. 2, the lever member 51 is provided oscillatably at a position below the notch groove 12 in the latch housing 11, that is, below the latch 21 and on the vehicle outside of the ratchet 22. Explaining more specifically, the lever member 51 is a plate-shaped body formed so that one part of the peripheral face thereof is substantially flat and the other parts of the peripheral face have an arcuate shape, and has a shaft unit 511 and a contact unit 512. The shaft unit 511, which is a unit forming the oscillation center of the lever member 51, is formed at a position shifting from the central portion of the lever member 51 to the side on which the peripheral face is substantially flat. The contact unit 512 is formed at a position most distant from the shaft unit 511 of the peripheral face of the lever member 51. The lever member 51 has a spring member, not shown, between the lever member 51 and the latch housing 11, and is disposed in such a manner that the contact unit 512 is located on the downside as shown in FIG. 2 in the normal state by being biased counterclockwise in FIG. 2 by the spring member. On the other hand, although the details are described later, when the lever member 51 is oscillated clockwise in FIG. 2 against the biasing force of the spring member, the contact unit 512 advances onto the rotation locus of the locking unit 213 of the latch 21 and comes into contact with the locking unit 213. Thereby, the latch 21 is oscillated counterclockwise against the biasing force of the latch spring, i.e., oscillated excessively in the direction of closing operation. The lever member 51 is configured so that the portions other than the contact unit 512 do not advance onto the rotation locus of the locking unit 213 of the latch 21 even if the lever member 51 oscillates. Also, the biasing force of the spring member is made lower than the biasing force of the latch spring.

The actuator 52 is a driving unit that gives power to the lever member 51 to oscillate the lever member 51 around the axis of the shaft unit 511, specifically, to oscillate the lever member 51 in the clockwise direction in FIG. 2 when a drive command is given from a control unit 70, described later. The actuator 52 has a drive motor and a speed reducing mechanism such as a worm gear, and is used to give the power of the drive motor to the lever member 51 via the speed reducing mechanism.

The detection switch 53 is a detecting unit that is provided near the open lever 30 to detect the door opening operation of the open lever 30 and send it to the control unit 70, described later, as a detection signal. The timing of detection of the detection switch 53 is set so that the detection signal is sent to the control unit 70 before the ratchet 22 performs the disengaging operation, more specifically, so that the time point at which the lever member 51 comes into contact with the latch 21 and excessively oscillates the latch 21 is earlier than the time point at which the ratchet 22 performs the disengaging operation.

Figure 6:
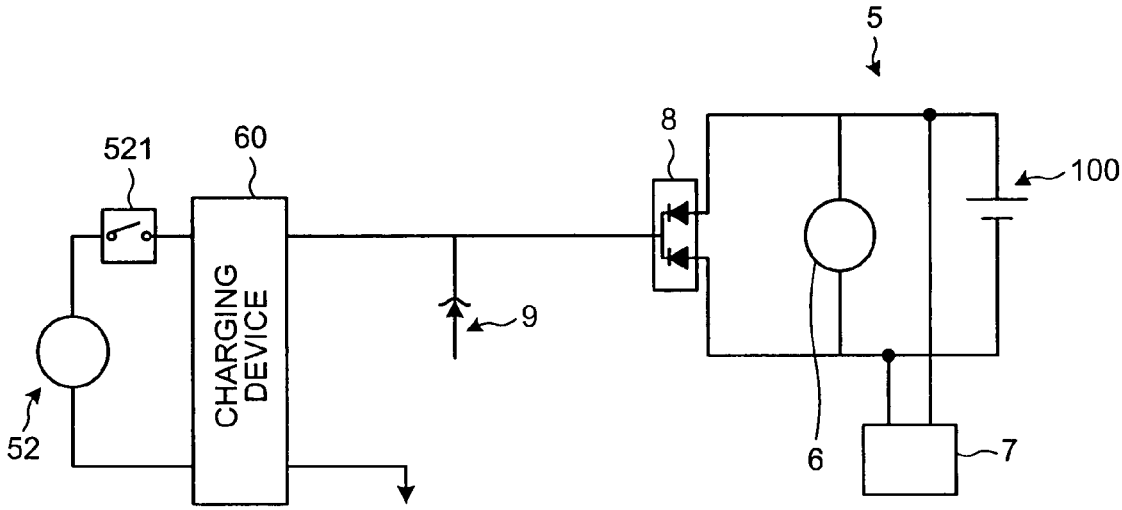
FIG. 6 is a diagram schematically showing a part of an electric wiring of a vehicle to which a latch device according to the embodiment is applied.

The charging device 60 supplies a driving current to the actuator 52. The charging device 60 is referred to as an electric double layer capacitor (EDLC). FIG. 6 is a diagram schematically showing a part of an electric wiring of the vehicle to which the latch device according to the embodiment of the present invention is applied. Referring to FIG. 6 appropriately, the charging device 60 is explained. In FIG. 6, the charging device 60 is connected to a battery (power supply device) 100 mounted on the vehicle so as to be in parallel with a drive motor 6 constituting the door lock mechanism. The drive motor 6 is connected to the battery 100 via a control circuit 7. The control circuit 7 controls the flow of electricity to the drive motor 6 to rotate the drive motor 6 in the normal and reverse directions according to the changeover of lock mechanism between the locked state and the unlocked state. By connecting the charging device 60 in this manner, the remainder of the driving current supplied from the battery 100, which is not used by the drive motor 6, flows into the charging device 60. Therefore, the charging device 60 can store the remaining driving current. Reference numeral 8 in FIG. 6 denotes a commutator, and 9 denotes a Zener diode that stabilizes the voltage applied to the charging device 60.

To the charging device 60, the actuator 52 is connected. When a drive command is given from the control unit 70, described later, a drive switch 521 is turned on, and the stored driving current is supplied from the charging device 60 to the actuator 52. Thereby, the actuator 52 is driven, and resultantly the lever member 51 is oscillated. When the drive switch 521 is turned off by the command from the control unit 70, the driving current is not supplied from the charging device 60 to the actuator 52, so that the drive of the actuator 52 is stopped.

Figure 7:
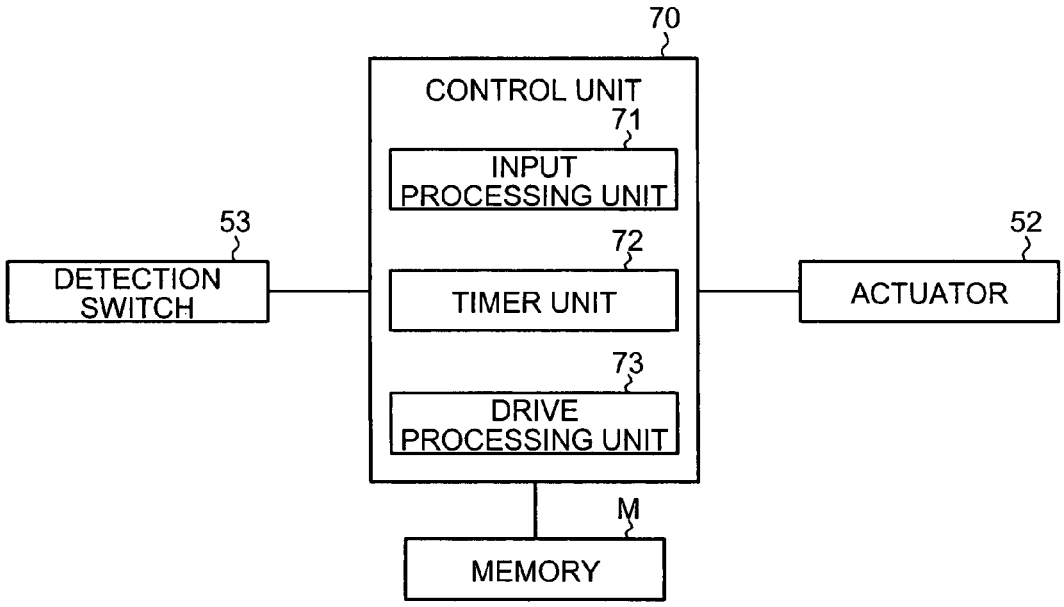
FIG. 7 is a block diagram schematically showing a control system for a release assisting unit constituting a latch device according to the present invention.

FIG. 7 is a block diagram schematically showing a control system for the release assisting unit constituting the latch device according to the present invention. As shown in FIG. 7, the release assisting unit 50 is configured so as to have the control unit 70. The control unit 70 collectively controls the operation of the release assisting unit 50 in accordance with the data and programs stored in a memory M, and includes an input processing unit 71, a timer unit 72, and a drive processing unit 73. The control unit 70 may be incorporated in a controller (not shown) that collectively controls the operation of the latch device 10, or may be independent of the controller. In the embodiment, explanation is given by assuming that the control unit 70 is independent of the controller.

The input processing unit 71 inputs and processes the detection signal sent from the detection switch 53. The timer unit 72 measures preset time. The preset time has a time length necessary and sufficient for the lever member 51 to oscillate excessively and for the ratchet 22 to perform the disengaging operation. The drive processing unit 73 sends a drive command to the actuator 52 to drive the actuator 52.

The operation of the latch device 10 described above is explained. First, when the side door 2 is in an open state with respect to the vehicle body 1, the latch 21 of the latch mechanism 20 is arranged in the open position, as shown in FIG. 3. When the side door 2 is closed from the state, the striker S provided on the vehicle body 1 advances relatively into the notch groove 12 in the latch housing 11, and shortly the striker S comes into contact with the locking unit 213 of the latch 21. As a result, the latch 21 turns counterclockwise in FIG. 3 against the biasing force of the latch spring, that is, performs a closing operation. During the time, the projecting end face of the engagement unit 221 of the ratchet 22 is brought into sliding contact with the outer peripheral face of the latch 21, by which the ratchet 22 is oscillated around the axis of the ratchet shaft 22*a* appropriately according to the outer peripheral face shape of the latch 21.

When the side door 2 is closed further from the state, the amount of relative advance of the striker S with respect to the notch groove 12 increases gradually, so that the latch 21 further turns counterclockwise, and shortly the engagement unit 221 of the ratchet 22 reaches the engagement groove 211 of the latch 21, as shown in FIG. 4. In the state, the locking unit 213 of the latch 21 is in contact with the engagement unit 221 of the ratchet 22. Therefore, the clockwise rotation of the latch 21 is inhibited against the elastic restoring force of latch spring. Moreover, since the hook unit 212 of the latch 21 is arranged so as to cross the notch groove 12, an accident such that the striker S moves in the direction of separating from the notch groove 12, that is, the opening operation of the side door 2 with respect to the vehicle body 1 is inhibited. That is to say, the side door 2 becomes in a half-closed state (half latch state).

When the side door 2 is further closed from the half latch state, the latch 21 is further turned counterclockwise (closing operation) via the locking unit 213 by the striker S relatively advancing in the notch groove 12, and the striker S reaches the inner part (vehicle outside) of the notch groove 12. During the time, the ratchet 22 is oscillated clockwise in FIG. 4 against the biasing force of the ratchet lever spring by the contact of the hook unit 212 of the latch 21 with the upper face of the engagement unit 221, and at the time when the hook unit 212 of the latch 21 passes through the upper face of the engagement unit 221, the ratchet 22 is immediately oscillated counterclockwise by the elastic restoring force (biasing force) of the ratchet lever spring. As the result, as shown in FIG. 5, the hook unit 212 of the latch 21 comes into contact with the engagement unit 221 of the ratchet 22. Therefore, the clockwise rotation of the latch 21 against the elastic restoring force (biasing force) of the latch spring, that is, the opening operation is inhibited. In the state as well, since the hook unit 212 of the latch 21 is arranged so as to cross the notch groove 12, the accident such that the striker S moves in the direction of separating from the inner part (vehicle outside) of the notch groove 12 is inhibited. That is to say, the side door 2 becomes in a fully-closed state (full latch state).

Figure 8:
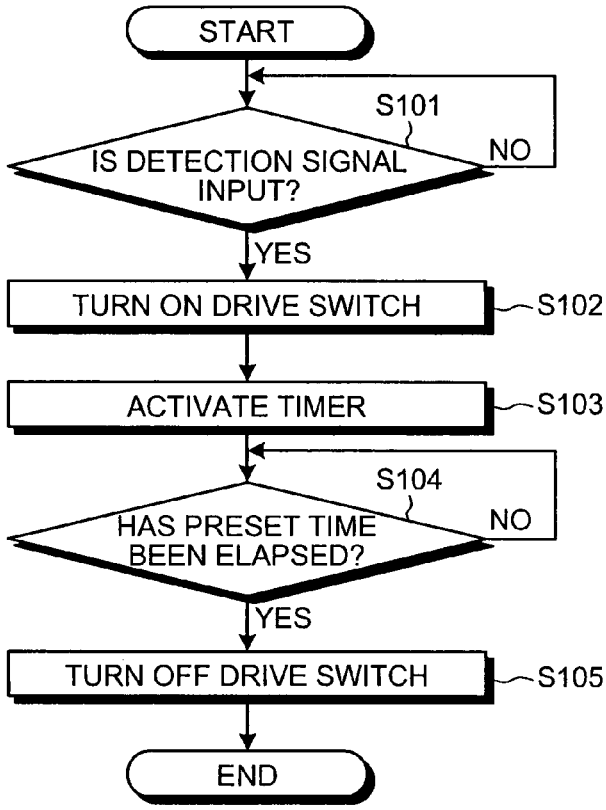
FIG. 8 is a flowchart showing the processing content of a control unit constituting a release assisting unit.
Figure 9:
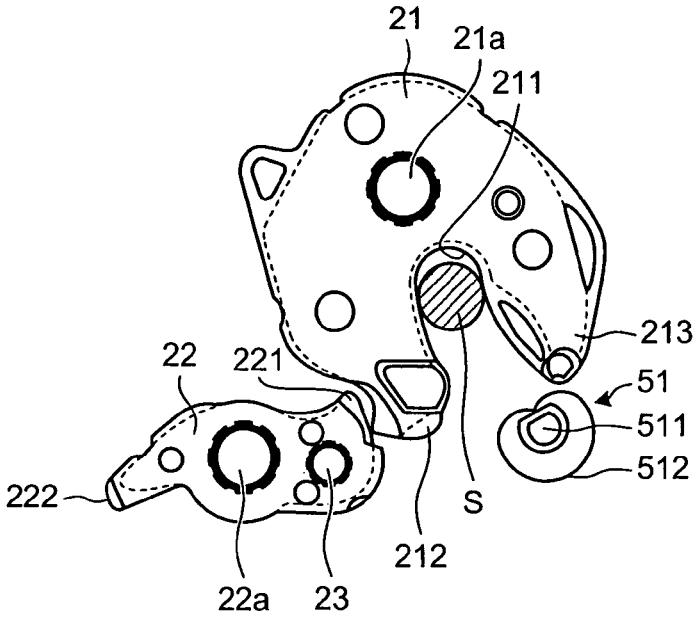
FIG. 9 is an explanatory view schematically showing an operation of an essential portion of a latch device in the full latch state.

In the full latch state, when the operating handle (the inside handle 3, the outside handle 4) is operated to open the door, the latch device 10 operates as described below. FIG. 8 is a flowchart showing the processing content of the control unit constituting the release assisting unit. FIGS. 9 to 14 are explanatory views schematically showing the operation of the essential portion of the latch device.

In the full latch state, that is, in the state in which the side door 2 is fully closed with respect to the vehicle body 1, when the user operates the operating handle (the inside handle 3, the outside handle 4) to open the door, the open lever 30 connected to the operating handle performs the door opening operation.

In such a case, the control unit 70 of the release assisting unit 50 checks whether or not the detection signal from the detection switch 53 has been inputted and processed through the input processing unit 71 (Step S101), that is, checks whether or not the detection switch 53 has detected the door opening operation of the open lever 30.

Figure 10:
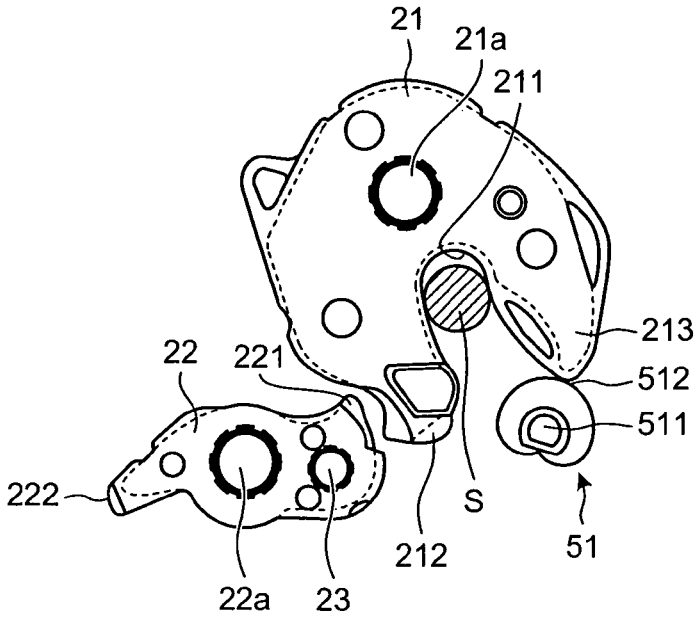
FIG. 10 is an explanatory view schematically showing an operation of an essential portion of a latch device in which the contact unit comes into contact with and presses the locking unit.
Figure 11:
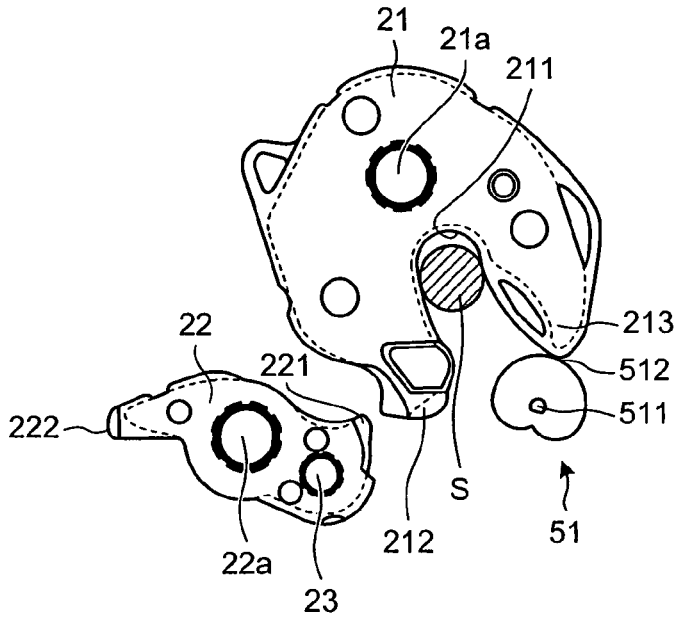
FIG. 11 is an explanatory view schematically showing an operation of an essential portion of a latch device in which the ratchet is oscillated clockwise and performs the disengaging operation through the open lever and the ratchet lever.

When the detection signal has been inputted and processed, the control unit 70 turns on the drive switch 521 through the drive processing unit 73, and measures the time through the timer unit 72 (Steps S102 and S103). Thereby, the driving current is supplied from the charging device 60, and the actuator 52 is made in an energized state, that is, in a driving state. The power from the actuator 52 is transmitted to the lever member 51, and the lever member 51 oscillates clockwise in FIG. 9 against the biasing force of the spring member. By the oscillation of the lever member 51, the contact unit 512 of the lever member 51 is advanced onto the rotation locus of the locking unit 213 of the latch 21. Thereafter, the contact unit 512 of the lever member 51 comes into contact with and presses the locking unit 213 of the latch 21 in the full latch state, by which as shown in FIG. 10, the latch 21 is excessively oscillated counterclockwise, that is, excessively oscillated in the direction of closing operation. By excessively oscillating the latch 21 in this manner, the engaging state between the hook unit 212 of the latch 21 and the engagement unit 221 of the ratchet 22 is released. Subsequently, as shown in FIG. 11, the ratchet 22 is oscillated clockwise, that is, performs the disengaging operation through the open lever 30 and the ratchet lever.

The control unit 70 checks whether or not the time preset through the timer unit 72 has been elapsed (Step S104). If it is made sure that the time has been elapsed, the drive switch 521 is forcedly turned off even if the detection signal has been inputted (Step S105), and the processing of the cycle is finished. By turning off the drive switch 521 in this manner, the energized state of the actuator 52 is released, that is, the driving current from the charging device 60 is not supplied, and the drive of the actuator 52 is stopped.

Figure 12:
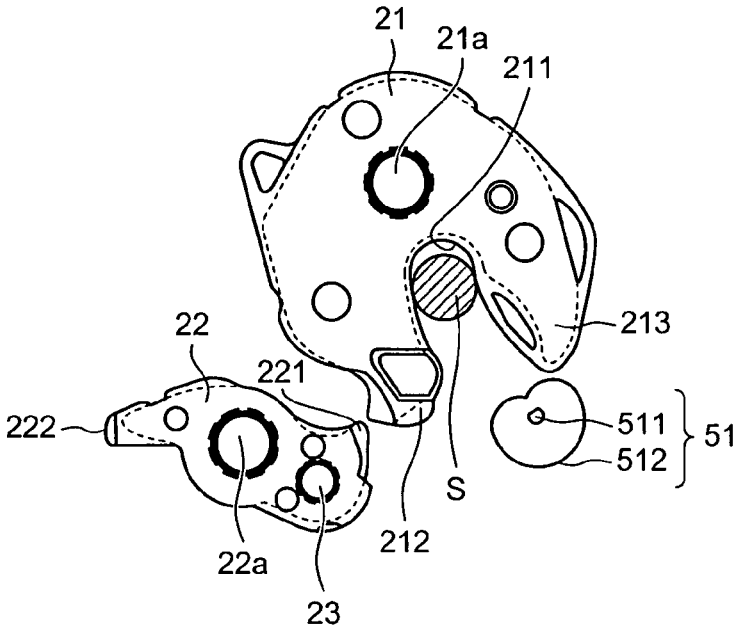
FIG. 12 is an explanatory view schematically showing an operation of an essential portion of a latch device in which the drive of the actuator is stopped and the lever member is oscillated counterclockwise.
Figure 13:
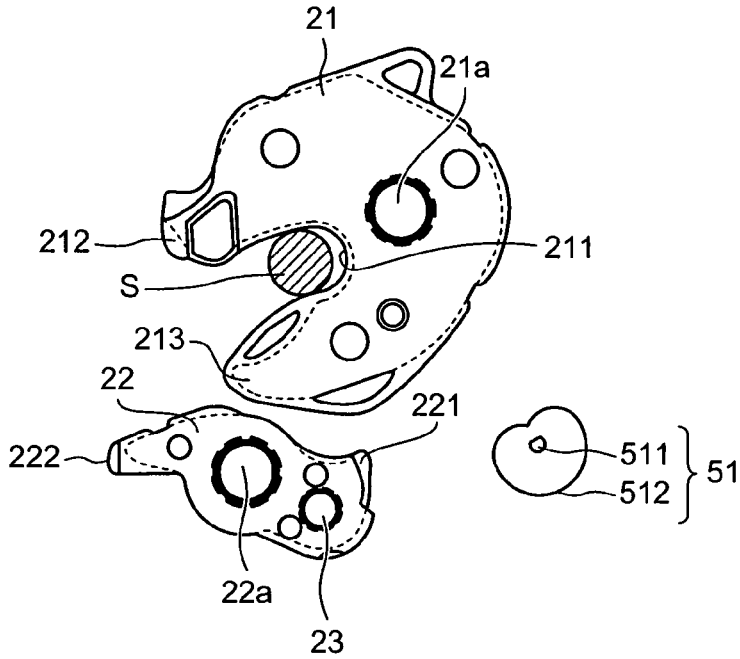
FIG. 13 is an explanatory view schematically showing an operation of an essential portion of a latch device in which the latch is oscillated clockwise by the biasing force of the latch spring.
Figure 14:
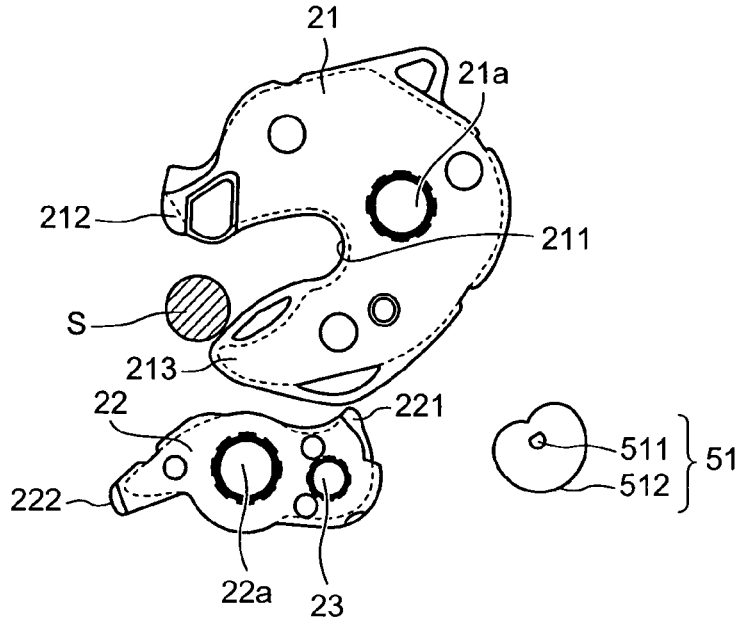
FIG. 14 is an explanatory view schematically showing an operation of an essential portion of a latch device in which the striker is allowed to separate from the engagement groove.

When the drive of the actuator 52 is stopped in this manner, as shown in FIG. 12, the lever member 51 is oscillated counterclockwise by the biasing force of the spring member. Thereby, the contact unit 512 is separated from the rotation locus of the locking unit 213. Then, the latch 21 is oscillated clockwise as shown in FIGS. 13 and 14 by the biasing force of the latch spring, that is, performs the opening operation. When the latch 21 is located at the open position, the striker S is allowed to separate from the engagement groove 211. Thereby, the latch device 10 allows the side door 2 to open with respect to the vehicle body 1.

As explained above, in the latch device 10 according to the embodiment of the present invention, since the release assisting unit 50 drives as a result of the opening operation of the operating handle, the release of the half-closed state and the fully-closed state of the side door is aided by the open lever 30. Therefore, the operating force required for the opening operation of the operating handle can be reduced. Also, the charging device 60 stores some of the driving current supplied to the driving source of the lock mechanism that is switched over between the unlocked state in which the opening operation of operating handle is effective and the locked state in which the opening operation of operating handle is ineffective between the operating handle and the latch mechanism 20, and on the other hand, supplies the driving current stored in the release assisting unit 50 to drive the release assisting unit 50. Therefore, the driving current supplied to the lock mechanism can be used effectively. Moreover, unlike the conventional latch device, the latch device in accordance with the present invention does not use expensive equipment such as a power release mechanism, and does not require an excessive installation space. Therefore, the driving current supplied to the driving source of lock mechanism is used effectively, and hence the operating force required for the opening operation of the operating handle can be reduced while the manufacturing cost is reduced and the size of device is decreased.

Also, according to the latch device 10, during the time from the opening operation of the inside handle 3 or the outside handle 4 to the disengaging operation of the ratchet 22, the lever member 51 is in contact with the latch 21 in a state of engaging with the striker S, and excessively oscillates the latch 21 in the direction of the closing operation, by which the engaging state between the latch 21 and the ratchet 22 is released. Therefore, by the opening operation performed by the user, the ratchet 22 that has been released from the engagement with the latch 21 is merely disengaged. That is to say, by merely disengaging the ratchet 22 that has been released from the reaction force (biasing force) of the latch spring and the reaction force of a seal member, such as a weather strip WS, provided between the vehicle body 1 and the side door 2, the operating force required for the opening operation of the operating handle can be reduced.

Further, according to the latch device 10, since the biasing force of the spring member is made smaller than the biasing force of the latch spring, even if the oscillation of the lever member 51 is stopped by a failure etc. in the state in which the contact unit 512 advances onto the rotation locus of the locking unit 213 of the latch 21, the lever member 51 is oscillated by the contact with the latch 21 that performs the opening operation due to the biasing force of the latch spring. Therefore, there is no fear of hindering the opening operation of the latch 21. Thereby, even if the lever member 51 fails, the performance equivalent to that of the conventional latch device can be ensured.

The above is a description of the preferred embodiment of the present invention. The present invention is not limited to the embodiment, and various changes can be made. For example, in the embodiment, the lever member 51 is oscillated, and is returned to the initial position by the biasing force of the spring member. In the present invention, however, the lever member may be configured so as to be returned to the initial position after making a round in the clockwise direction by the drive of the actuator 52.

According to the latch device in accordance with the present invention, the operating force required for the opening operation of operating handle can be reduced. Furthermore, the driving current supplied to the lock mechanism can be utilized effectively. Moreover, unlike the conventional latch device, the latch device in accordance with the present invention does not use expensive equipment such as a power release mechanism, and does not require an excessive installation space. Therefore, an effect is achieved that the driving current supplied to the driving source for the lock mechanism is utilized effectively, by which an operating force required for the opening operation of operating handle can be reduced, while the manufacturing cost is reduced and the size of device is decreased.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A latch device comprising:

a latch mechanism that is disposed on one of a vehicle body and a door body, and is configured to hold the door body in a fully-closed state with respect to the vehicle body, wherein the latch mechanism includes:

a latch that is disposed turnably on one of the vehicle body or the door body, that is configured to perform an opening operation and a closing operation, that is constantly biased in a direction of the opening operation by a biasing unit, and that is configured to perform the closing operation against a biasing force generated by the biasing unit by the closing operation of the door body such that the latch engages with a striker disposed on other of the vehicle body and the door body, and a ratchet that is disposed oscillatably to perform an engaging operation and a disengaging operation, is configured to engage with the latch by the engaging operation to hold an engaging state, and that is configured to release the engaging state by the disengaging operation, wherein the ratchet comprises a ratchet lever disposed so as to be oscillatable around an axis of a ratchet shaft and a ratchet lever spring provided to always bias the ratchet lever toward a counterclockwise direction;

an open lever that is connected to an operating handle provided on the door body and disposed oscillatably to perform a door opening operation by an opening operation of the operating handle, and that is configured to release the fully-closed state held by the latch mechanism by the door opening operation;

a release assisting unit that is triggered by the opening operation of the operating handle, and is configured to assist the release of the fully-closed state of the door body by the open lever, wherein the release assisting unit comprises:

a lever member that is in contact with the latch in the engaging state, wherein the lever member is configured to rotate about a shaft unit and is disposed in a latch housing, wherein the shaft unit is disposed to be parallel to a latch shaft of the latch, a detecting unit configured to detect the door opening operation of the open lever, and an actuator configured to oscillate the lever member around an axis of the shaft unit based on a detection of the door opening operation by the detecting unit such that the lever member is brought into contact with the latch;

a control unit configured to control the actuator to rotate the lever member in a clockwise direction so as to cause an excessive oscillation of the latch in the counterclockwise direction for a preset time counted by a timer to disengage a hook unit of the latch from an engagement unit of the ratchet; and a charging device configured to charge a portion of a driving current supplied to a driving source of a lock mechanism that is switched over between an unlocked state in which the opening operation of the operating handle is enabled and a locked state in which the opening operation of the operating handle is disabled between the operating handle and the latch mechanism, and configured to supply a charged driving current to the release assisting unit, wherein the charging device is connected to a battery mounted on the vehicle so as to be in parallel with the driving source of the lock mechanism.

2. The latch device according to claim 1, wherein the lever member is configured to excessively oscillate the latch in a direction of the closing operation such that the engaging state between the latch and the ratchet is released during the time from the opening operation of the operating handle to the disengaging operation of the ratchet.

* * * * *